United States Patent [19]

Fishman et al.

[11] Patent Number: 4,961,383

[45] Date of Patent: Oct. 9, 1990

[54] COMPOSITE TUNGSTEN-STEEL ARMOR PENETRATORS

[75] Inventors: Steven G. Fishman, Columbia; Alexander G. Rozner, Potomac; Raymond C. Wiley, Rockville, all of Md.; William N. Wishard, Dahlgren, Va.

[73] Assignee: The United States of America as represented by the Secretary of the Navy, Washington, D.C.

[21] Appl. No.: 280,589

[22] Filed: Jun. 26, 1981

[51] Int. Cl.[5] ..... F42B 12/00

[52] U.S. Cl. ..... 102/517; 75/229; 102/501

[58] Field of Search ..... 192/501, 517–519; 75/229, DIG. 1, 245, 246, 248; 29/419; 428/569

[56] References Cited

U.S. PATENT DOCUMENTS

| | | | |
|---|---|---|---|
| 3,291,577 | 12/1966 | Davis et al. | 75/DIG. 1 |
| 3,353,932 | 11/1967 | Shanley | 75/DIG. 1 |
| 3,419,952 | 1/1969 | Carlson | 75/DIG. 1 |
| 3,546,769 | 12/1970 | Schwope et al. | 75/DIG. 1 |
| 3,599,573 | 8/1971 | Sliney | 102/517 |
| 3,663,356 | 5/1972 | Li | 75/229 |
| 3,864,807 | 2/1975 | Schneider et al. | 29/419 R |
| 3,889,348 | 6/1975 | Lemelson | 75/229 |
| 4,055,887 | 11/1977 | Meyer | 29/599 |

*Primary Examiner*—Charles T. Jordan
*Assistant Examiner*—Rochelle Lieberman
*Attorney, Agent, or Firm*—Kenneth E. Walden; Roger D. Johnson

[57] ABSTRACT

An armor penetrating projectile having a matrix of iron or a steel alloy which has a Rockwell C hardness of from about 40 to about 60 and a density of from about 99.5 to 100 percent, the matrix being reinforced with wires of a heavy metal such as tungsten, molybdenum, tantalum, or alloys of these metals.

7 Claims, 2 Drawing Sheets

PROJECTILE HARDNESS PROFILE ($R_C$)

COMPOSITE TUNGSTEN-STEEL ARMOR PENETRATORS

BACKGROUND OF THE INVENTION

This invention relates to ordnance and more particularly to armor penetrating projectiles.

In order to increase the offensive capability of light armored vehicles, the U.S. Marine Corps can either increase the size of the weapons systems on such vehicles or the penetration capability of the projectiles of existing systems. Since the expense of replacing existing 0.50 caliber weapons systems with systems possessing larger guns is great, there is considerable interest in developing a more effective 0.50 caliber machine gun bullet. The problem can be approached from several aspects: improved materials, more efficient penetration mechanisms, higher impact velocities, etc. Among the most promising new materials are metal matrix composites (MMC).

It was the severe operating conditions subjected on space age components for the aerospace industry which resulted in the development of composite materials science as we know it. Up until this time, the vast majority of composite development has been in the field of structural materials. In particular, materials with high strength, high stiffness, low density and elevated operating temperatures have been sought. More recently, scientists and engineers have recognized the advantages of applying MMC technology for other than structural applications. In such applications, physical, chemical, electrical, magnetic and other nonstructural properties may be of importance.

In the field of military ordnance, in addition to the importance of normal engineering structural properties of materials, we are concerned with high strain rate effects and shock wave interactions between composite components. The failure mechanisms of composite munitions will undoubtably be different than for those fabricated by homogeneous materials. A study of failure mechanisms in ballistic penetrators may yield information useful in designing both more efficient penetrators and better armors to defeat these penetrators.

Composite materials used for aerospace applications have been, for the most part, low in quantity and high in cost. For conventional ordnance applications, the material cost is frequently of prime importance, and significant improvement must be demonstrated to justify even modest cost increases. As a result, it is important to develop inexpensive fabrication techniques for composite material ordnance. The most feasible of these would be simple modifications of existing casting, powder metallurgy, extrusion, etc. techniques currently used for fabricating homogeneous metals.

SUMMARY OF THE INVENTION

Accordingly, an object of this invention is to increase the offensive capability of existing weapons systems on light armored vehicles.

Another object of this invention is to provide projectiles having increased armor penetrating power.

A further object of this invention is to provide effective, low cost armor penetrating rounds.

Still another object of this invention is to provide an economical process for manufacturing improved armor penetrating rounds.

These and other objects of this invention are accomplished by providing an armor penetrating projectile comprising:

A. a metal matrix comprising a material selected from the group consisting of steel alloys and iron wherein the matrix material has a Rockwell C hardness of from about 40 to about 60 and a density from about 99.5 to 100 percent; and B. heavy metal wires reinforcing the metal matrix wherein the wires are made of a heavy metal selected from the group consisting of tungsten, alloys of tungsten, molybdenum, alloys of molybdenum, tantalum, and alloys of tantalum, and wherein the volume percentage of the heavy metal wires in the projectile is from about 25 to about 45 with the matrix material constituting the remainder.

BRIEF DESCRIPTION OF THE DRAWINGS

A more complete understanding of the invention and a fuller appreciation of the many attendant advantages thereof will be derived by reference to the following detailed description when considered in connection with the accompanying drawings wherein.

DETAILED DESCRIPTION OF THE PREFERRED EMBODIMENT

Figure 1:
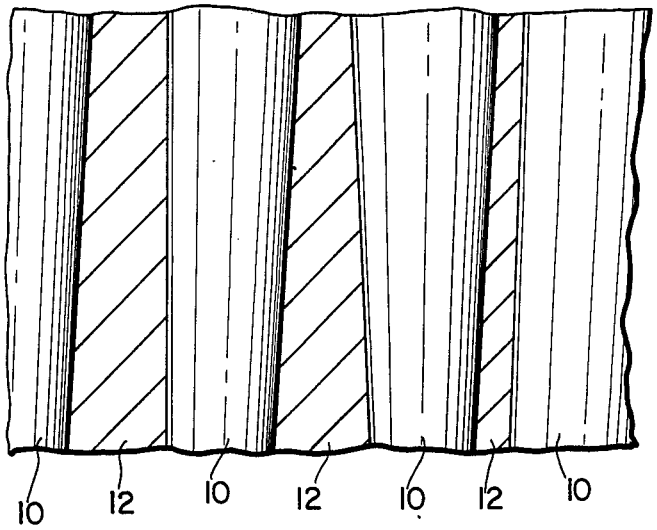
FIG. 1 is a longitudinal view of the microstructure ( 100×) of a typical composite.

The armor penetrating projectiles of the present invention comprise an iron or steel matrix which is reinforced with heavy metal wires or rods. The particular composition of the steel used is not critical to the armor penetrating ability of the projectile. The critical factor is the hardness of the matrix material. The matrix material should have a Rockwell C hardness ($R_c$) of from about 40 to about 60, and preferably from 50 to 55. If the matrix material has a $R_c$ much above 60, the projectile will be brittle and will shatter upon impact. If it has an $R_c$ much below 40, the projectile will spall, resulting in poor penetration of the armor.

The wires or rods are made of tungsten, molybdenum, tantalum, or alloys of tungsten, molybdenum, or tantalum which contain less than 10 percent by weight of other elements. (In other words, the tungsten, molybdenum, or tantalum alloy contains at least 90 weight percent of tungsten, molybdenum, or tantalum respectively.) More preferred are tungsten and its alloys with tungsten being the most preferred. The wires (or rods) may be of any shape, but cylindrical wires are preferred because they result in better stress properties in the projectile. The diameter of the wires is not critical. Wires ranging from 15 mils to 125 mils have been found to work well, and it is expected that wires of larger and of smaller diameters will also produce projectiles having good armor penetration abilities.

The volume percent of wire in the projectile should be from about 25 to about 45 and preferably from 30 to 40. The wires may be distributed in the matrix in any manner, but preferably they run parallel to each other along the longitudinal direction of the projectile. It is also preferable that the wires be uniformally distributed so that the ballistic characteristics of the projectile are good and are predictable from round to round.

Figure 2:
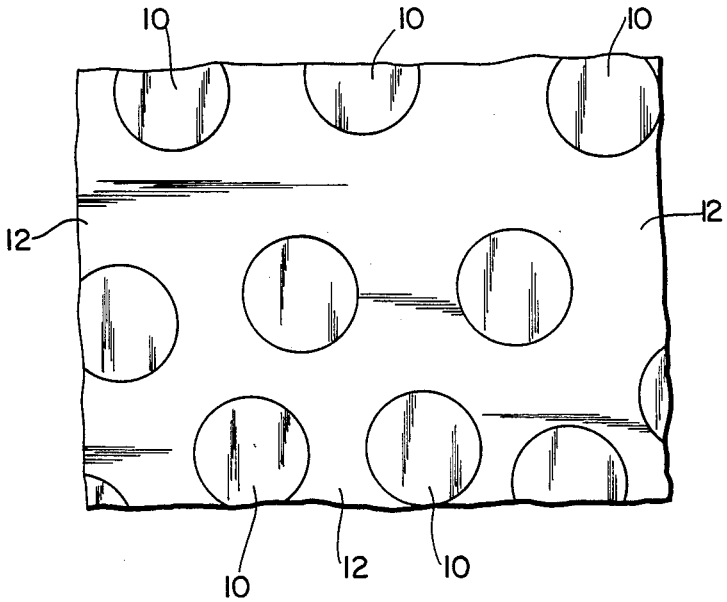
FIG. 2 is a traverse view of the microstructure ( 100×) of that same composite.
Figure 3:
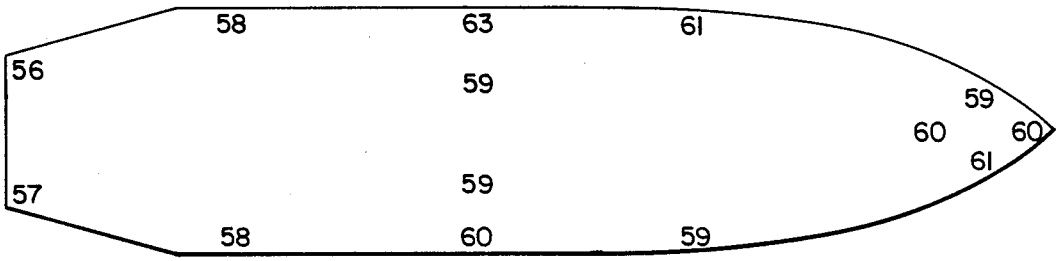
FIG. 3 is a hardness profile of a typical armor penetrating projectile according to this invention.

FIG. 1 represents an enlarged ( 100×) longitudinal view of a typical composite: 99.6% density, 4660 steel matrix, $R_c=60$, 30 volume percent of 15 mil tungsten alloy (98% W-2% $ThO_2$) wire. FIG. 2 represents a transverse view of the same composite.

Figure 4:
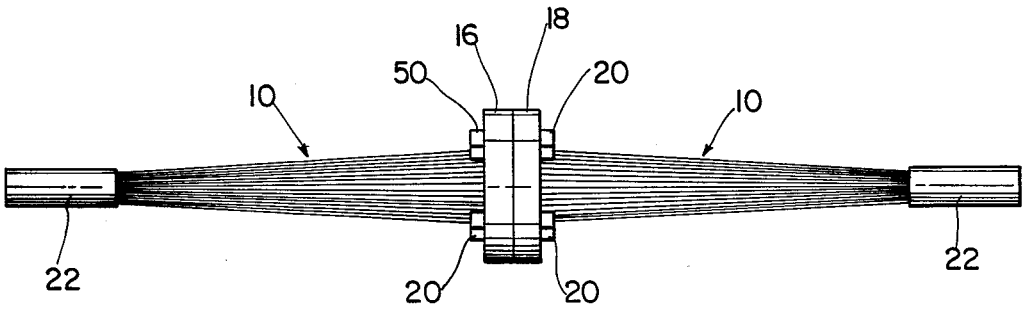
FIGS. 4, 5, and 6 illustrate the use of a collimator to position the heavy metal wires and are discussed in detail in the detailed description of the préferred embodiment.
Figure 5:
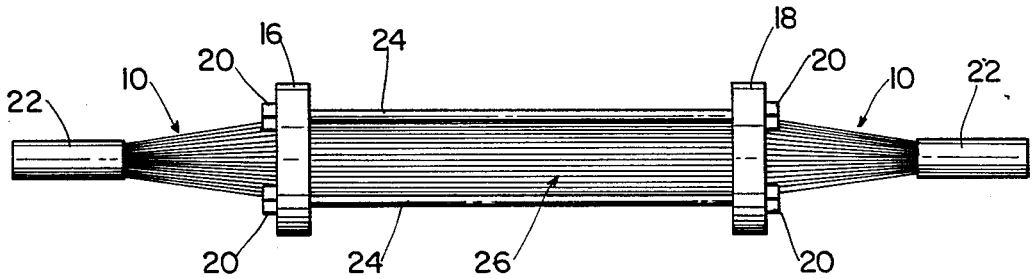
Figure 6:
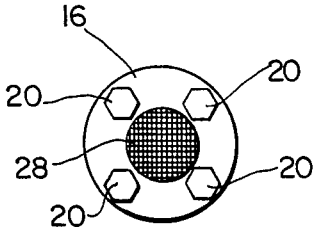

The first step in manufacturing the penetrator is to arrange the wires and fix them in place. A preferred method is to use a wire collimator as shown in FIGS. 4, 5, and 6. FIG. 4 shows the collimator in the closed position. Rings 16 and 18 have coarse screening welded to them. (Fine screening is used when a closer packing is desired). The reinforcing heavy metal wires 10 are fed through the screening of both rings and are thus held in place. The wires 10 are tied together at their ends 22.

FIG. 5 show the collimator in its expanded or open position. Rings 16 and 18 are pushed apart and held in that position by expansion rods 24 which are fastened to the rings 16 and 18 by hexagonal nuts 20. In the region 26 between rings 16 and 18 the wires 10 are essentially parallel. FIG. 6 shows a front view of a ring 16 with hexagonal nuts 20 and the screening material 28.

The second step is to press the composite. The collimator and wires are put into a rubber mold and the spaces in and around the wires are filled with steel or iron powder. It is preferable to use a very find powder (−500 mesh) so that a dense packing is achieved. However, coarser powder (e.g., +85 to −325) can also be used. The shape of the powder particles is also important to the packing density. Least preferred are spherical particles. Flat particles, such as elongated flags, are preferred because they pack better. Also particles of varying size pack better than those of uniform size.

The mold is sealed and placed into a pressure vessel and subjected to a hydrostatic pressure which exceeds the yield strength of the iron or steel. Some plastic flow of the iron or steel and some local deformation of the particles occurs. An object is to stress the particles. In general, a hydrostatic pressure of 120,000 psi is suitable for iron and most steels.

The resulting composite is then separated from the pressure vessel, mold, and collimator.

In the third step, the pressed powder-wire composite is sintered in a protective atmosphere of hydrogen (a reducing gas) or an inert gas (e.g., argon, Helium). The gas must be free of reactive materials (e.g., $H_2O$) which would contaminate the composite. The iron or steel particles are sintered for a few hours at a temperature which is preferably as close to the melting point as is possible without melting occurring. In example 1, 4600 steel particles (−80÷+325 mesh) were sintered at 1150° C. for two hours in a dry hydrogen atmosphere.

After sintering the composite is hot deformed to obtain fully dense, uniform, cylindrical rods. Any hot working process (swaging, extrusion, etc.) may be used.

The final step is to harden the projectile to the desired value. This can be done by austenizing, followed by water quenching, and then cold working at an elevated temperature (e.g., about 400° C.). In the example, a tungsten wire-4600 steel matrix composite was austenized at 855° C., water quenched, and then aged at 400° C. for 1 hour to achieve a Rockwell C hardness of 43. Other conventional procedures may be used to achieve the desired hardness. The critical factor is the hardness of the projectile (from about 40 to about 60 $R_c$, and more preferably from 50 to 55 $R_c$) and not the method by which it is achieved.

The armor penetrating projectile is then made (e.g., machined) from the composite rod.

The general nature of the invention having been set forth, the following examples are presented as a specific illustration thereof. It will be understood that the invention is not limited to these specific examples but is susceptible to various modifications that will be recognized by one of ordinary skill in the art.

EXAMPLE 1

The reinforcing were made of a tungsten alloy (98 wt % tungsten +2 wt % $ThO_2$) and were 15 mil in diameter. The wires were collimated to achieve relatively uniform distribution with the wires running parallel to each other. The collimator and wires were placed in a rubber mold and 4600 steel powder (−80÷+325 mesh) premixed with graphite (in order to obtain 0.6 weight percent of carbon in the matrix, i.e., 4660 steel) was poured into the mold to fill the space between and around the wires.

The mold was sealed, placed in a pressure vessel, and subjected to a hydrostatic pressure of 120,000 psi. After the pressurization, the composite was removed from the mold, separated from the collimator and sintered under a protective atmosphere of hydrogen for 2 hours at 1150° C. The hydrostatic compaction and sintering process resulted in 80÷85% densification of the composite. After sintering the material was hot deformed by swaging to obtain fully dense, uniform, cylindrical rods. As the result of hot deformation only a small redistribution of the W-wires occurred. The center to center distance between the wires was reduced, while the wire configuration remained essentially unchanged. The hot deformed rods were austenized at 855° C. and water quenched. After quenching the rods were drawn at 400° C. for 1 hr. in order to reach a required hardness level of $R_c$40–45. The final composite was 30 volume percent of tungsten–2% $ThO_2$ wires and 70 volume percent of steel matrix.

The addition of 0.6 weight percent graphite to the 4600 steel results in a matrix of 4660 steel. In other tests 4660 powdered steel was used without graphite to produce the same 4660 steel matrix. The carbon content is not critical; 4660 steel was selected because it is inexpensive and commercially available. Moreover, the carbon content was held constant at 0.60 weight percent (4660 steel) so that is would not be a factor in the test comparisons.

EXAMPLE 2

Rounds were prepared according to the procedure of Example 1 except that the 4660 steel matrix was harden to $R_c=60$. The armor penetrating properties of these rounds were compared with that of (1) conventional APM-2 rounds, (2) unreinforced 4600 steel ($R_c=60$) rounds, and (3) rounds using 30 volume percent of the tungsten wires but aluminum as the matrix. The results are presented in Table 1. The performance of the tungsten wire reinforced steel rounds was superior to all the others.

TABLE 1

Ballistic Data Tabulation for Experimental Cores against RHVA[1] Targets, 0° Obliquity

| No. | Type[2] | Import Velocity fps | Import Energy $10^3$ ft-lb | RHVA[1], in. | Remarks |
|---|---|---|---|---|---|
| 1 | APM2 | 2865 | 12.7 | 1 | Perforation |
| 2 | APM2 | 2886 | 12.9 | 1 | Perforation |
| 3 | 4660 | 2969 | 12.9 | 1 | Stuck in plate |
| 4 | 4660 | 2941 | 12.6 | 1 | Perforation |
| 5 | w/4660 | 2833 | 13.7 | 1 | Perforation |
| 6 | w/4660 | 2821 | 13.6 | 1 | Perforation |
| 7 | w/Al | 3038 | 11.2 | 1 | Shallow dent in plate |
| 8 | w/Al | 2999 | 11.7 | 1 | Shallow dent in plate |
| 9 | APM2 | 2879 | 12.8 | 1.5 | Bulged second plate |
| 10 | APM2 | 2867 | 12.7 | 1.5 | Bulged second plate |
| 11 | 4660 | 2960 | 12.8 | 1.5 | Bulged second plate |
| 12 | 4660 | 2925 | 12.5 | 1.5 | Bulged second plate |
| 13 | W/4660 | 2824 | 13.7 | 1.5 | Perforation |
| 14 | W/4660 | 2831 | 13.8 | 1.5 | Perforation |

1. RHVA—Rolled homogeneous vehicular armor
2. APM2—Standard APM-2 core 4660—Core made of 4660 steel ($R_c = 60$) no W wire reinforcement W/4660—core made of 4660 steel matrix ($R_c = 60$) reinforced with 30 vol % of W-2%$ThO_2$, 15 mil wires W/Al—Aluminum matrix reinforced with 30 Vol % w-2%$ThO_2$ 15 mil wires.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An armor penetrating projectile comprising:

A. a metal matrix comprising a material selected from the group consisting of steel alloys and iron wherein the matrix material has a Rockwell C hardness of from about 40 to about 60 and a density from about 99.5 to 100 percent of the theoretical density of the matrix material; and B. heavy metal wires reinforcing the metal matrix wherein the wires are made of a heavy metal selected from the group consisting of tungsten, alloys of tungsten, molybdenum, alloys of molybdenum, tantalum, and alloys of tantalum, wherein the alloys contain at least 90 weight percent of the heavy metal, wherein the volume percentage of the heavy metal wires in the projectile is from about 25 to about 45 with the matrix material constituting the remainder; wherein the wires are cylindrical having a diameter of from 15 to 125 mils, wherein the wires run parallel to each other along the longitudinal axis of the projectile for the length of the projectile without touching each other, and wherein the wires are uniformly distributed in the projectile to provide good ballistic characteristics.

2. The projectile of claim 1 wherein the hardness of the matrix material is from 50 to 55, Rockwell C.

3. The projectile of claim 1 wherein the metal wires are made of a material selected from the group consisting of tungsten and alloys of tungsten.

4. The projectile of claim 3 wherein the metal matrix material is a steel alloy.

5. The projectile of claim 2 wherein the metal wires are made of a material selected from the group consisting of tungsten and alloys of tungsten.

6. The projectile of claim 5 wherein the metal matrix material is a steel alloy.

7. The projectile of claim 1, 2, 3, 4, 5, or 6 wherein the volume percent of metal wire is from 30 to 40.

* * * * *